US007373860B1

(12) United States Patent
Rinner

(10) Patent No.: US 7,373,860 B1
(45) Date of Patent: May 20, 2008

(54) SCREWDRIVER T-HANDLE

(76) Inventor: James A. Rinner, 585 92nd St., Franksville, WI (US) 53126

( * ) Notice: Subject to any disclaimer, the term of this patent is extended or adjusted under 35 U.S.C. 154(b) by 0 days.

(21) Appl. No.: 11/488,403

(22) Filed: Jul. 19, 2006

(51) Int. Cl.
*B25B 23/16* (2006.01)
*B25G 1/00* (2006.01)

(52) U.S. Cl. ..... 81/177.1; 81/489; 81/177.5; D8/83; 16/430

(58) Field of Classification Search ..... 81/177.5, 81/177.1, 489; 16/430, 110.1; D8/82, 83, D8/300
See application file for complete search history.

(56) References Cited

U.S. PATENT DOCUMENTS 2,950,746 A * 8/1960 Towne ..... 81/177.1
3,672,419 A * 6/1972 Fischer ..... 81/460
D259,698 S * 6/1981 MacNeill ..... D8/107
D309,246 S 7/1990 Cascio
5,069,091 A 12/1991 Bramsiepe
D356,239 S * 3/1995 Lin ..... D8/82
D377,444 S 1/1997 Lin
D393,791 S * 4/1998 Halls et al. ..... D8/107
5,829,099 A * 11/1998 Kopelman et al. ..... 16/430
5,924,941 A 7/1999 Hagey
6,145,151 A * 11/2000 Herron et al. ..... 15/143.1
6,151,998 A 11/2000 Fu-Hui
6,230,593 B1 * 5/2001 Hsieh ..... 81/177.5
D454,045 S 3/2002 Rinner
6,681,664 B1 * 1/2004 Hsien ..... 81/489
6,988,295 B2 1/2006 Tillim

* cited by examiner

*Primary Examiner*—D. S Meislin

(57) ABSTRACT

A screwdriver T-handle having an upright stem portion and a top horizontal cross-bar portion, and together they form a letter T shape in both face views thereof. A groove on each of those faces of the handle provides for reception of the user's thumb when the handle is being gripped by the remainder of the user's hand for rotation to apply a threaded fastener, and the cross-bar presents an S shape in top plan view thereof.

2 Claims, 2 Drawing Sheets

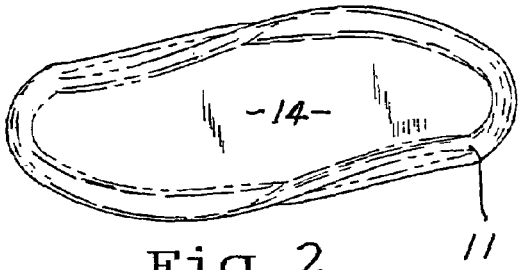
Fig.2
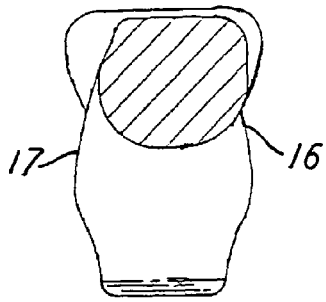
Fig.5
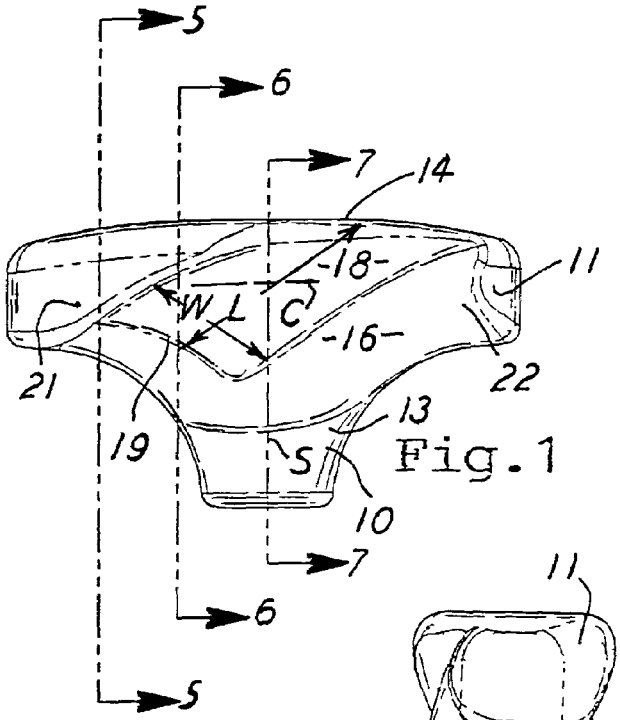
Fig.1
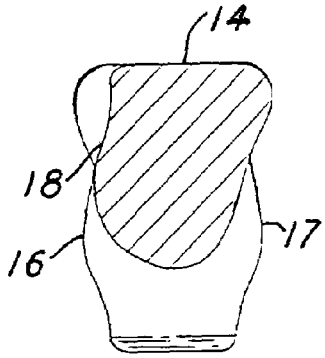
Fig.6
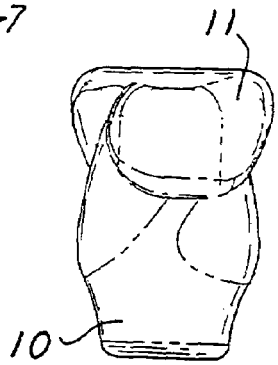
Fig.3
Fig.7
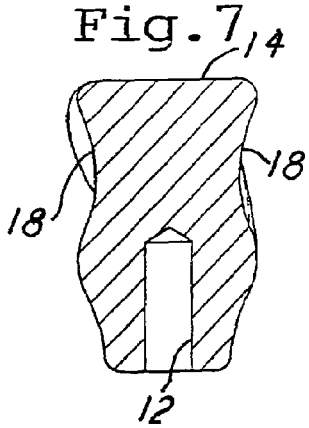
Fig.4
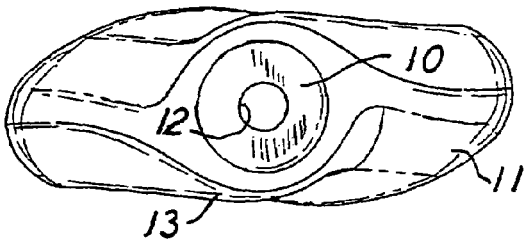

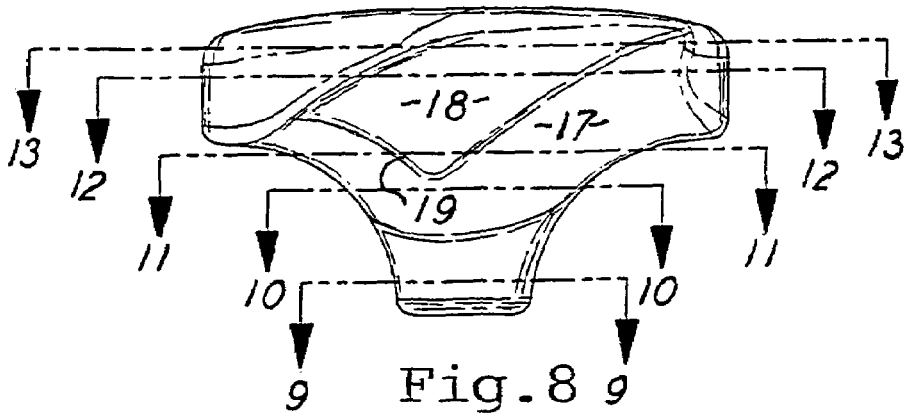
Fig.8
Fig.9
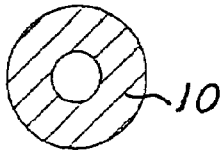
Fig.10
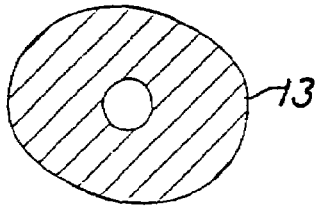
Fig.11
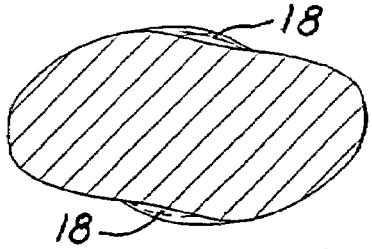
Fig.12
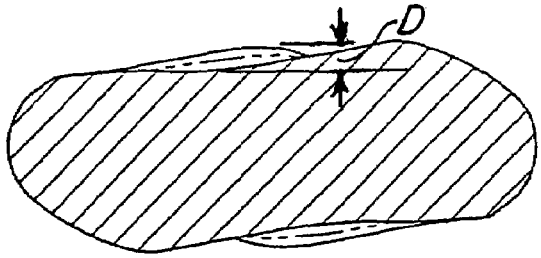
Fig.13
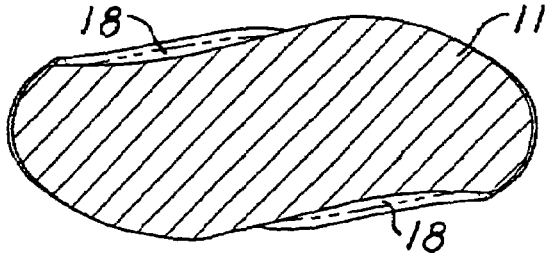

SCREWDRIVER T-HANDLE

This invention relates to a screwdriver T-handle.

The prior art is aware of T-handles, and they are useful for rotational driving while presenting a portion of the handle to lie along the palm of the user's hand and thereby induce rotation to the handle. In that arrangement, the T-handle provides rotation drive that has optimum torque compared to an in-line type handle.

The present invention improves upon T-handles in that it presents the usual T-shape with a stem portion and a cross-bar portion, all forming the T-shape. The cross-bar portion has a depression therein arranged to receive the user's thumb when the handle is being gripped for rotation action. That is, the users hand surrounds the cross-bar portion with the hand palm extending therealong and then the user's thumb also lies along the cross-bar portion.

With the aforementioned arrangement, there is greater accuracy in directing the handle and there is also greater torque exertable through the handle, all due to the included action and positioning of the user's thumb in the torquing action. That is, the thumb along the cross-bar portion is positioned to press on the cross-bar portion in exerting torque through the entire handle.

Also, this T-handle can be gripped at either side of the handle because the handle is configured the same on its two opposite sides. That is, the user need not grip the handle from only one side to achieve the advantages herein, but there can be gripping from either side for the same effect.

BRIEF DESCRIPTION OF THE DRAWINGS

FIG. 1 is a side view of a T-handle showing my new design;

FIG. 2 is a top plan view thereof;

FIG. 3 is both a right end and left end views thereof;

FIG. 4 is a bottom plan view thereof;

FIGS. 5, 6, and 7 are section views taken respectively on planes designated by the lines 5-5, 6-6, and 7-7;

FIG. 8 is a side view thereof taken from the side opposite from FIG. 1 and on a slightly reduced scale, the T-handle being the same from the two sides; and FIGS. 9, 10, 11, 12, and 13 are section views taken respectively on planes designated by the lines 9-9, 10-10, 11-11, 12-12, and 13-13.

DETAILED DESCRIPTION OF A PREFERRED EMBODIMENT

The drawings show this handle to include a stem portion 10 and a cross-bar portion 11, all being integral in the usual arrangement of a T-handle to present the shape of a capital letter T in front view, such as FIGS. 1 and 8. There is an opening 12 aligned with the stem portion and extending into the handle for reception of an unshown bit or the like for rotating to an unshown screw or like threaded fastener. That will be understood by one skilled in this art.

So the stem portion 10 extends in an upright longitudinal orientation along an axis S, and the cross-bar portion 11 extends in a horizontal longitudinal orientation along an axis C, perpendicular to axis S, all as seen in FIG. 1. The handle can be made from one piece of material, and there is a fillet or concave conically shaped surface 13 at the juncture of the two portions mentioned and extending circularly around the entire handle.

Numerous convex surfaces are shown on the handle, such as seen in the full and sections views. That is, there are no sharp corners, and the exterior surfaces shown are arranged to comfortably accommodate the user's hand. That is, the palm of the user's hand can lie along the cross-bar portion 11, and the fingers of the hand can be wrapped around the cross-bar portion 11, except for the user's thumb. The tips of the user's different fingers can straddle the stem portion 10 and be on the surface 13.

The cross-bar portion 11 can have a planar upper surface 14, and the user's palm can lie along that surface during gripping in the torque-applying mode. The user's fingers, except for the thumb, can wrap around the cross-bar portion and onto the surface 13, all for firm gripping. The handle has identically shaped upright faces 16 and 17, and there is a groove 18, in the form of a depression, in each of the faces 16 and 17. Each groove 18 extends merged with and off the top surface 14 at an angulation, as seen in the drawings, and is adjacent the top surface 14 and extends to one groove edge 19 on the respective faces 16 and 17, and the two grooves extend toward the stem portion 10. Both the grooves 18 are at a respective, and same, acute angle with respect to the horizontal in the front face view of the handle, as seen with plane C in FIG. 1. Both grooves are concave and have a bottom termination adjacent the line 19.

The user's thumb can lie in either one of the grooves 18 when the remainder of the user's hand can grip the T-handle in the manner mentioned. In that positioning, the thumb can exert a torque or pressing force on whichever face 16 or 17, depending on the particular grip employed by the user, all in the right hand or clockwise rotation action of the T-handle, as viewed from above. The disposition of the grooves is such that the user's thumb extends across the upright plane shown at S with a horizontal component, and the thumb can therefor exert a firm torquing action onto the handle.

Also, the T-handle is of a serpentine shape in its top view, as seen in FIG. 2, and that further conforms to the optimum shape for accommodating the user's gripping hand. So the T-handle is defined as having a slight S-shape in the top view thereof. The handle is identical relative to both face views thereof, and the grooves 18 have a length along the line L which extends at up to forty-five degrees in those face views and relative to the horizontal axis C. The grooves 18 each extend from the top 14 to the juncture surface 13 between the cross-bar and the stem. That groove angulation is critical and thereby guides the thumb for optimum torque direction by the thumb and about the axis S.

So the grooves 18 have a length L, a width W, and a depth D. The length L is dimensionally the greatest, the width W is next, and the depth D is the smallest. That relationship most efficiently receives the user's thumb for handle accuracy, comfort, and force application. The cross-bar portion has two end portions 21 and 22, and each groove 18 extends between the two ends 21 and 22 and thus across the cross-bar portion 11 and to the juncture between the cross-bar 11 and the stem 10, that is, into the concave conical surface 13.

What is claimed is:

1. A screwdriver T-handle to be gripped by a user's hand for rotating fasteners and having a stem portion extending along a first axis and a cross-bar portion extending along a second axis perpendicular to said first axis and said cross-bar portion having a planar top surface and two sides and with said two portions forming the letter T in an elevation side view thereof, the improvement comprising:

said cross-bar portion having two ends spaced apart along said second axis, two grooves respectively on said sides and extending substantially along the complete said sides and each of said grooves presenting a concavity for respective contact by the user's thumb, a first one of said grooves on a first one of said sides and angularly extending longitudinally relative to the top surface plane and from a first one of said ends and adjacent said top surface to a second one of said ends and spaced from said top surface, a second one of said grooves on a second one of said sides and angularly extending longitudinally relative to the top surface plane and from a second one of said ends and adjacent said top surface to the first end and spaced from said top surface, for selective contact with the user's thumb in either of said grooves for the same direction of rotation of said handle in only one direction of rotation from thumb contact with either one of said grooves, and each said groove having a length and a width and with said length being greater in dimension than that of said width and being an arcuate concave shape in viewing along said length and thereby across said width.

2. The screwdriver T-handle as claimed in claim 1, further comprising:

said cross-bar portion being shaped to present an S-shape in a plan view of said top surface, and said cross-bar portion being shaped to receive the palm of the user's hand and said stem portion being shaped to receive the user's fingers, all when a rotation torque is applied to said T-handle.

* * * * *